US005833200A

United States Patent [19]

Patterson

[11] Patent Number: 5,833,200

[45] Date of Patent: Nov. 10, 1998

[54] LAP DESK

[75] Inventor: Lawrence W. Patterson, Anaheim, Calif.

[73] Assignee: The Lawrence W. Patterson Trust, Anaheim, Calif.

[21] Appl. No.: 590,135

[22] Filed: Jan. 23, 1996

[51] Int. Cl.[6] ..... A47G 1/24

[52] U.S. Cl. ..... 248/456; 108/34

[58] Field of Search ..... 248/441.1, 446, 248/447, 454, 455, 456, 448, 457, 460; 5/2.1; 108/34

[56] References Cited

U.S. PATENT DOCUMENTS

| | | | |
|---|---|---|---|
| 2,014,176 | 9/1935 | Henderson | 248/456 |
| 2,219,091 | 10/1940 | Henderson | 248/456 |
| 2,419,721 | 4/1947 | Kopp | 248/456 |
| 3,123,935 | 3/1964 | Williams | 248/346.01 |
| 3,813,074 | 5/1974 | Mulvaney | 248/452 |
| 4,119,289 | 10/1978 | Kanocz | 248/454 |
| 4,940,003 | 7/1990 | Mayhew et al. | 108/44 |
| 5,054,736 | 10/1991 | Champoux | 248/444 |
| 5,265,541 | 11/1993 | Gordon | 108/34 |
| 5,290,003 | 3/1994 | Reyes | 248/461 |
| 5,393,030 | 2/1995 | Tarozzi | 248/460 |
| 5,598,786 | 2/1997 | Patterson | 108/43 |

*Primary Examiner*—Leslie A. Braun
*Assistant Examiner*—Anita M. King
*Attorney, Agent, or Firm*—Fulwider Patton Lee & Utecht, LLP

[57] ABSTRACT

A portable lap desk which is readily selectively adjustable in the height of the desk over the user's lap and includes a desk top which is readily selectively adjustable in tilt relative to the user.

4 Claims, 3 Drawing Sheets

LAP DESK

BACKGROUND OF THE INVENTION

This invention relates generally to a device for supporting articles while a user is seated in a chair, bed, or the like and particularly to a portable lap desk.

Laptop article support devices such as lap desks are known in the art. Typically, these devices are constructed as a frame having a pair of spaced apart legs which straddle the lap of a user and on which a horizontally disposed table is placed across and secured thereto. Some of the prior art laptop table devices are provided with adjustment means which allow for vertical height adjustment of the table top over the user's lap. Other laptop table devices allow for adjustment of the inclination of the table top relative to the table legs. The provision of an adjustable table top permits books, writing materials, cosmetics, and the like to be supported by the table top and positioned at a comfortable angle relative to the user.

Laptop table devices are frequently used in hospitals and nursing care homes for supporting not only reading and writing materials, but also tableware, dining utensils, and cosmetics. Since elderly, handicapped, and infirm persons often utilize laptop table devices and may lack manual dexterity, it is desirable that the table top adjustment be easy to operate without undue effort. It is further desirable that the top, when adjusted in its tilted position, will be securely locked relative to the supporting legs. Conventional arrangements for adjusting the height of the table top relative to the supporting legs have comprised a plurality of equally vertically spaced-apart recesses or openings spaced along the height of the adjustable legs. A pin or a catch is provided to engage one of the selected recesses or openings to lock the extendable legs at a vertically adjusted elevation relative to a user. Although this type of vertical adjustment means is effective in use, the height adjustment is restricted to the spacing between the recesses and can not be fine-tuned to the anatomical characteristics of all laptop table users as such users are sitting upright or partially reclining. It is essential that both the adjustment of the angle of the top relative to the user and the height of the top relative to the user, be accomplished without the use of tools. It is also important that a portable laptop table be sufficiently narrow to fit between the arms of wheelchairs, reclining armchairs, and be small enough for use in automobiles or on airplanes.

The lap desk of the present invention meets all of the needs set forth hereinabove as well as providing other advantages.

SUMMARY OF THE INVENTION

The present invention is directed to a portable lap desk to straddle the lap of a user. The desk includes a frame that is secured to a pair of legs vertically adjustably carried by the vertical side members of the frame to control the height of the top relative to a user. The frame also pivotally supports an article receiving top which may be adjusted upwardly and rearwardly relative to the user and securely adjusted at a desired angle in order that reading and writing materials, or the like, may be supported at a convenient viewing inclination relative to the user.

More particularly, the legs are provided with vertical adjustment slots which receive adjustment knobs interposed between the frame side members and the leg slots for locking the legs to the frame at a desired vertical spacing in order that the height of the desk top relative to the user may be fine-tuned to any desirable position. The desk top is positively supported at a desired tilted position by means of a tilt adjustment panel which is readily accessible to and operable by a user to positively secure the top at several different angles of tilt relative to the user. The lap desk of the present invention also includes a shelf disposed below the top for the convenient storage of reading and writing materials, or the like.

Other features and advantages of the present invention will become apparent from the following detailed description taken in conjunction with the accompanying drawings.

DETAILED DESCRIPTION OF A PREFERRED EMBODIMENT

Figure 1:
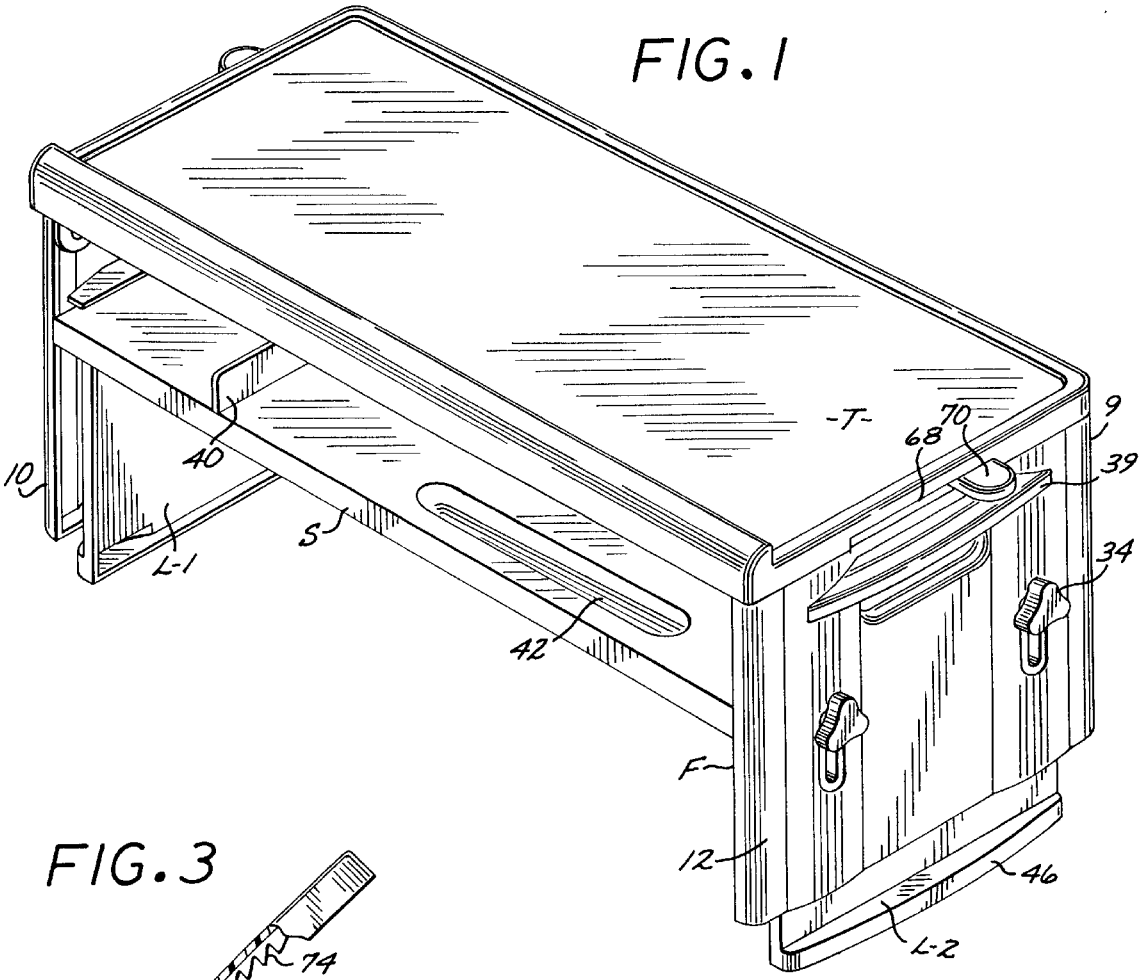
FIG. 1 is a perspective view of a portable lap desk embodying the present invention.
Figure 3:
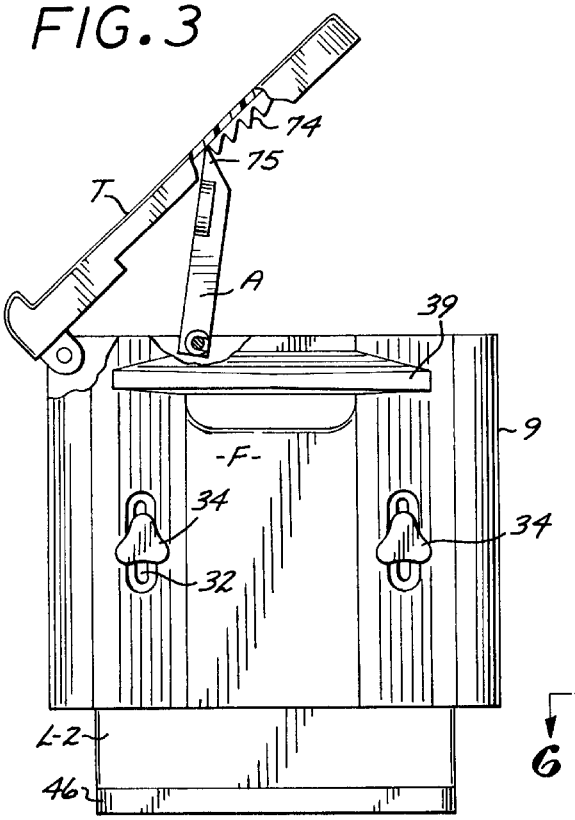
FIG. 3 is a side elevational view similar to FIG. 2, but showing the top tilted upwardly toward a user and the side support legs extended from their position of FIG. 2.
Figure 2:
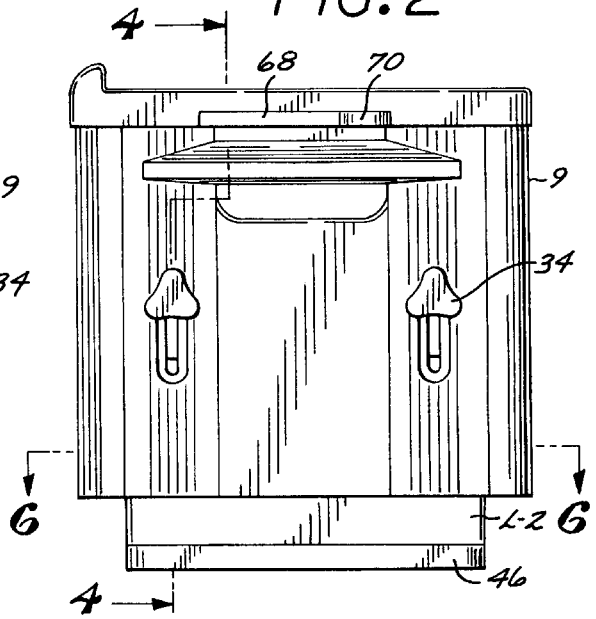
FIG. 2 is a side elevational view of said lap desk.

Referring to the drawings and particularly FIGS. 1–3, a lap desk embodying the present invention includes a frame F having a rear wall 9, vertical side walls, generally designated 10 and 12, rigidly connected by a horizontally extending storage shelf S, a pair of vertical support legs L-1 and L-2 adjustably carried by the side walls 10 and 12, an article-receiving top T pivotally supported along its rear edge by the frame F, and a tilt angle adjustment panel A interposed between the upper part of the frame F and the underside of the top T to control the vertical angularity between the frame and the top.

Figure 4:
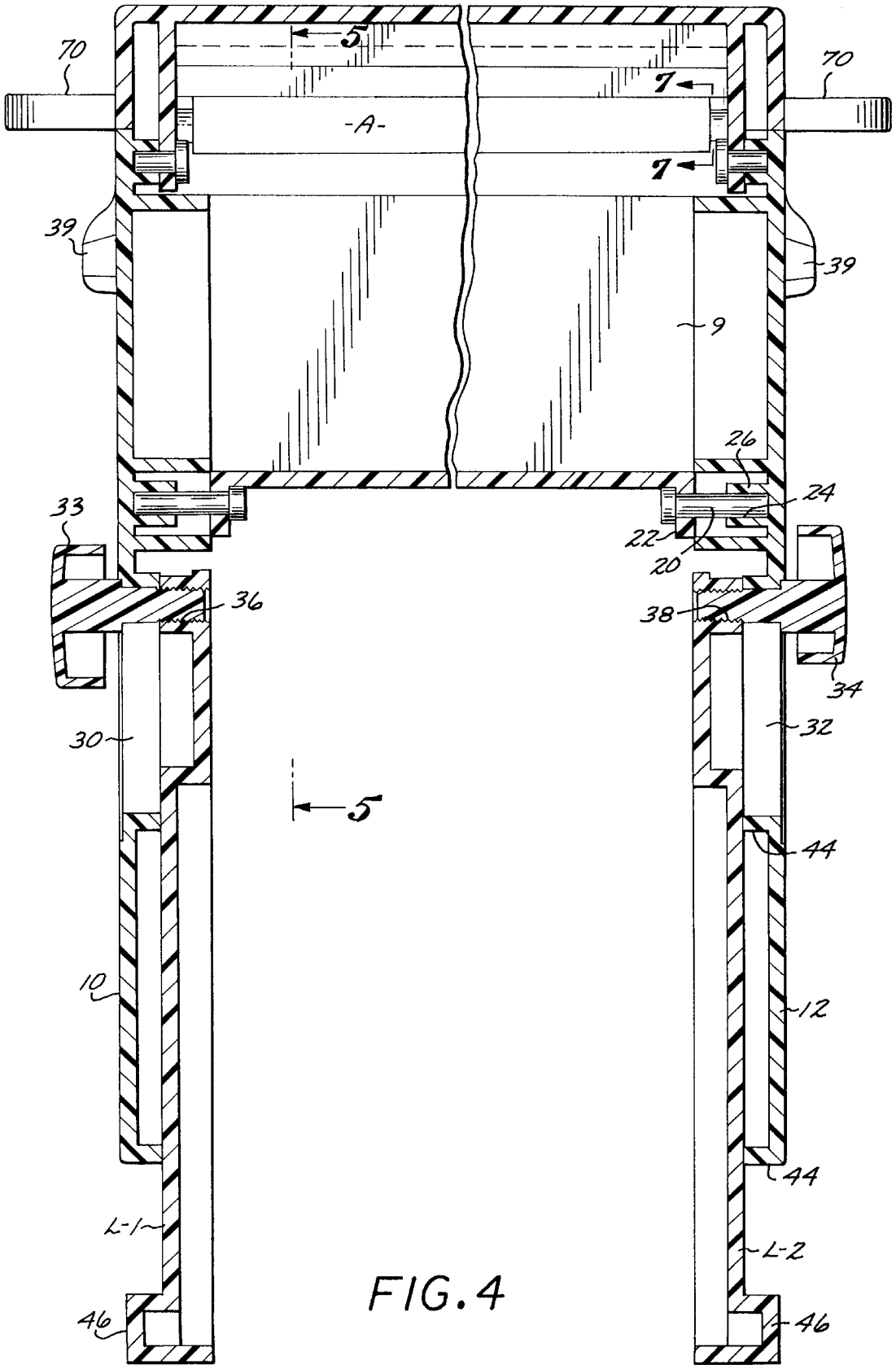
FIG. 4 is a vertical sectional view taken in enlarged scale along line 4—4 of FIG. 2.
Figure 5:
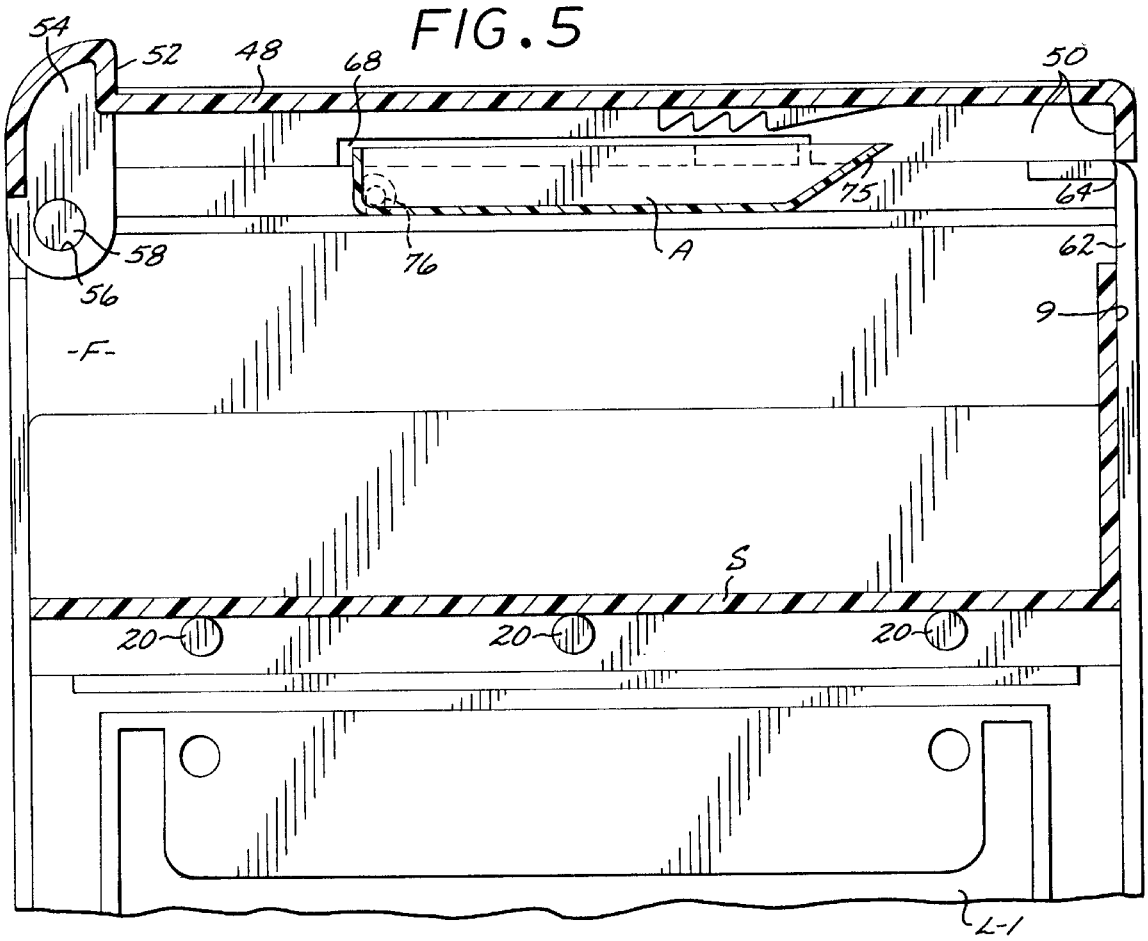
FIG. 5 is a broken vertical sectional view taken along 5—5 of FIG. 4.

More particularly, the sides of shelf S are rigidly affixed to the intermediate portion of each of the side walls 10 and 12 by three horizontally extending pins 20 which extend through the flanges 22 formed at the sides of the shelf S into blind bores 24 formed in inwardly extending complimentary bosses 26 on the side walls, as shown in FIGS. 4 and 5. Below the shelf S the legs L-1 and L-2 are formed with a pair of vertically extending adjustment slots 30 and 32. Such adjustment slots each receive a pair of like adjustment knobs 33 and 34, respectively, each having their threaded inner ends threadably received by complementary threaded bores 36 and 38 formed in the upper portion of side walls 10 and 12. The upper portion of the side walls 10 and 12 are exteriorly formed with lifting handles 39 by means of which the lap desk may be moved. The upper surface of shelf S may be formed with divider elements 40 for receiving paper materials and a recess 42 for receiving pens, pencils or the like. The support legs L-1 and L-2 are formed with inwardly projecting guide elements 44 which slidably abut the outer surfaces of side walls 10 and 12, as shown particularly in FIG. 4. The lower ends of the support legs are formed with foot pads 46 which rest on a horizontal surface of a bed, chair or other article of furniture (not shown).

Figure 6:
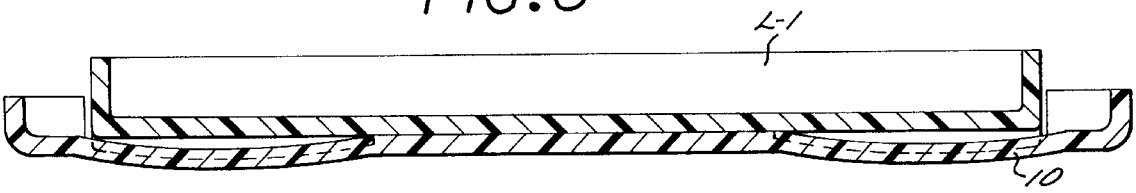
FIG. 6 is a horizontal sectional view taken in enlarged scale along line 6—6 of FIG. 2.
Figure 7:
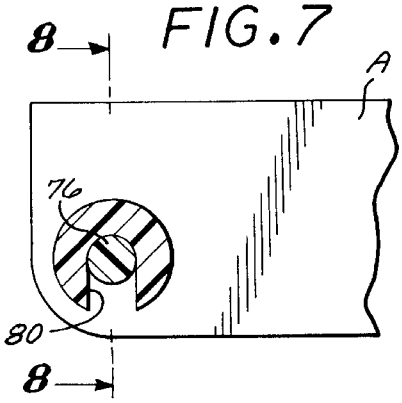
FIG. 7 is a broken vertical sectional view taken along line 7—7 of FIG. 4.
Figure 8:
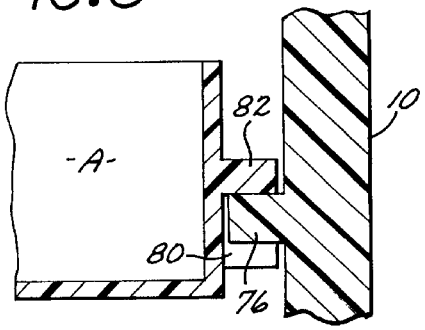
FIG. 8 is a broken vertical sectional view taken along line 8—8 of FIG. 7.

Top T includes a rectangular table member 48 which is provided with a peripheral lip 50 along its sides and rear edges, and an upstanding book rest 52 at its rear portion. As particularly indicated in FIGS. 4 and 5, a pair of hinge plates 54 depend from the opposite front sides of the top T. Such hinge plates are formed with aligned bores 56 that receive horizontal pivot pins 58 to permit the top T to be tilted upwardly and rearwardly by a user of the lap desk. Normally the top T will be supported in a horizontal position by the pivot pins 58 and the rear end component of lip 50 to engage the upper surface of the rear wall 62 of the frame F at 64. The upper intermediate portions of side walls 10 and 12 are formed with slots 68 through which extend lifting tabs 70 formed on opposite ends of the tilt adjustment panel A. Inwardly of slots 68 the underside of top T is formed with a plurality of upwardly extending adjustment notches 74 to selectively receive the pointed free end 75 of the tilt adjustment panel A to control the angularity of the top T relative to the frame F. As indicated in FIG. 4, tilt adjustment panel A extends horizontally across the upper portions of side walls 30 and 32. The front portion of tilt adjustment panel A is pivotally connected to the top of the side walls by a pair of inwardly extending horizontal pivot pins 76 formed in side walls 10 and 12, as shown particularly in FIGS. 5, 6, and 7. Pivot pins 76 are received within a downwardly extending groove 80 formed in inwardly extending bosses 82 formed on the outer portions of the tilt adjustment panel A.

All of the aforementioned components of the lap desk of the present invention are of a thickness which is rigid and structurally sound for purposes of regular anticipated lap desk use. The materials of construction and the selected dimensions and thicknesses thereof provide a lightweight, and therefore easily portable, lap desk. In addition, the primary components of the lap desk are formed of readily available and relatively inexpensive materials in which the cost effectiveness may be passed on to the consumer.

For example, the components of the afore described lap desk embodying the present invention may be formed of a suitable synthetic plastic combining strength with light weight and making the lap desk easy to clean. Other materials however could be utilized, such as aluminum or wood or a combination of suitable materials.

In the use of the afore described lap desk, the frame F will be disposed at right angles to the lap of a user with the foot pads 46 of the support legs L-1 and L-2 resting on the bed or chair of the user. The user may then utilize the adjustment knobs 33 and 34 to control the vertical extension of the legs relative to the frame's side walls 10 and 12 to thereby adjust the height of the desk top T to the preference of the user. The provision of the vertical adjustment slots 30 and 32 permit fine tuning of such height adjustment. The adjustment knobs 33 and 34 will be tightened within bores 38 to securely lock the legs to the side walls. Thereafter, the user may grasp the lifting tabs 70 to cam the top T upwardly and rearwardly to the angularity preferred by the user. Thereafter, the pointed end 75 of the tilt adjustment panel A will be disposed within one of the adjustment notches 74 to lock the table top at the desired angularity. To return the top T to a horizontal position the user merely lifts the rear end of the table top until the pointed free end 75 of the tilt adjustment panel is withdrawn from its respective adjustment slot in order that the table and the adjustment panel A may be returned to their horizontal position. The storage shelf S is readily adapted to receive reading and writing materials for convenient access by the user. It should be particularly noted that a woman user of the lap desk can position a mirror on the top T and thereafter adjust the angularity of the top for applying cosmetics. Also, such mirror and cosmetics can be stored on the shelf S for easy access by a user.

While a preferred embodiment of a lap desk embodying the present invention is shown and described herein, it will be apparent that various modifications and changes can be made without the departing from the spirit of the present invention.

What is claimed is:

1. A portable lap desk for straddling the lap of a user disposed in a sitting or reclining position on an article of furniture, such lap desk comprising:

a frame having a pair of vertically extending side walls for straddling the lap of a user;

a pair of vertically extending legs disposed adjacent the side walls, the lower ends of such legs adapted for resting on said article of furniture;

adjustment means interposed between each leg and its respective frame side wall, to control the vertical spacing between the frame and the legs, such adjustment means including a pair of vertical slots formed in the legs and an adjustment knob extending through each slot between the legs and the frame side walls;

a top having its rear end pivotably attached to the frame for movement between a horizontal position and an upwardly inclined position relative to a user;

abutment elements formed on the underside of the top;

a tilt adjustment panel extending across the side walls and having its rear end pivotally attached to the frame and its free end being selectively engageable by a user with one of said abutment elements to releasably lock the top at a desired angle relative to the frame; and an open-front article receiving storage shelf supported by the frame side walls, said storage shelf being spaced vertically below the top to provide access to such storage shelf.

2. The lap desk as set forth in claim 1 wherein the top's abutment elements are notches selectively and releasably engaged by a point formed on the free end of the tilt adjustment panel.

3. The lap desk as set forth in claim 1 wherein lifting pads are formed on the tilt adjustment panel that extend sidewardly from the side walls of the frame for manipulating the tilt adjustment panel to lift said top to a selected upwardly inclined position relative to a horizontal plane.

4. The lap desk as set forth in claim 1 wherein lifting pads are formed on the tilt adjustment panel that extend sidewardly from the side walls of the frame for manipulating the tilt adjustment panel to lift said top to a selected upwardly inclined position relative to a horizontal plane.

* * * * *